United States Patent [19]

Randall

[11] 4,099,599

[45] Jul. 11, 1978

[54] METHOD AND APPARATUS FOR FASTENING A DOOR PANEL TO A DOOR OPERATOR MOUNTED ON AN ELEVATOR CAR

[75] Inventor: Charles E. Randall, Biglerville, Pa.

[73] Assignee: Westinghouse Electric Corp., Pittsburgh, Pa.

[21] Appl. No.: 764,670

[22] Filed: Feb. 1, 1977

[51] Int. Cl.[2] ..... B66B 13/30

[52] U.S. Cl. ..... 187/52 R; 16/96 D; 49/409; 187/56

[58] Field of Search ..... 187/51, 52 R, 56, 52 LC, 187/58-60; 49/409, 116, 118; 16/96 D, 94 D

[56] References Cited

U.S. PATENT DOCUMENTS

| | | | |
|---|---|---|---|
| 2,751,637 | 6/1956 | Kraft | 49/409 |
| 2,905,463 | 9/1959 | Borden | 187/52 R |
| 3,033,317 | 5/1962 | Beck et al. | 187/52 R |
| 3,065,826 | 11/1962 | Tucker | 187/52 LC |
| 3,327,428 | 6/1967 | Horton et al. | 49/409 |
| 3,879,912 | 4/1975 | Cox | 49/409 |
| 4,004,655 | 1/1977 | Kraft et al. | 187/56 |

FOREIGN PATENT DOCUMENTS

| | | | |
|---|---|---|---|
| 249,609 | 10/1962 | Australia | 49/409 |
| 587,422 | 1/1959 | Italy | 187/51 |

*Primary Examiner*—Evon C. Blunk
*Assistant Examiner*—Jeffrey V. Nase
*Attorney, Agent, or Firm*—D. R. Lackey

[57] ABSTRACT

An elevator system including an elevator car, an elevator door, and a door operator for operating the door to open and close an entranceway to the car. The door has integral hanger brackets which are fastened to a hanger plate associated with the door operator. The door may be easily mounted, oriented and aligned in the field by a fastening arrangement and method which includes clamping bolts and jacking bolts. The clamping bolts are adjusted to initially support the weight of the door. Jacking bolts are then coupled between the hanger bracket and hanger plate, and the jacking bolts are actuated to align the door and set the sill gap. The clamping bolts are then tightened to maintain the selected alignment and sill gap. The clamping bolts, jacking bolts and the frictional area contact between the clamped surfaces all co-operate to support the weight of the door, and the clamped surfaces additionally function to add structural stiffness to the door and its support.

6 Claims, 6 Drawing Figures

METHOD AND APPARATUS FOR FASTENING A DOOR PANEL TO A DOOR OPERATOR MOUNTED ON AN ELEVATOR CAR

BACKGROUND OF THE INVENTION

1. Field of the Invention:

The invention relates in general to elevator systems, and more specifically to new and improved apparatus and methods for mounting elevator doors on elevator cars.

2. Description of the Prior Art:

In the elevator art it is common to manufacture the elevator car door hanger plates as an integral part of the door assembly. This arrangement results in substantial field assembly time when the door is mounted on the elevator car. The door is set into place by hanging the hanger rollers mounted on the hanger plate on the hanger roller track and the door alignment and sill gap are checked. If the alignment and/or sill gap is not correct, the door must be removed, the hanger rollers adjusted or shimmed, the door replaced, rechecked, etc., until the desired alignment and sill gap are obtained. Additional problems arise with two-speed door combinations. A two-speed door includes two door sections which retract to the same side of the entranceway. Clearances between the hanger plate hardware often become interferences when vertical adjustments are made. Access to shim and make adjustments, always difficult, is even more of a problem with the two-speed door.

SUMMARY OF THE INVENTION

Briefly, the present invention is a new and improved elevator system including an elevator car having an entranceway, a door operator mounted on the elevator car, and one or more door panels mounted for rectilinear movement by the door operator to open and close the entranceway to the car. The hanger brackets are manufactured as an integral or non-adjustable part of each door panel, and the doors are shipped to the job site. The hanger plate is factory mounted to the door operator with hardware in place and all adjustments factory set, and the assembly is shipped to the job site as a package.

Fastener hardware, which is preferably pre-assembled with tape in the proper slots on the hanger plate, is coupled to the hanger brackets from the hall side of the entranceway. The fastener hardware includes clamping bolts and jacking bolts. The clamping bolts, which are horizontally oriented, couple and clamp major flat surfaces of the hanger brackets and hanger plates to support the weight of the door while the jacking bolts, which are vertically oriented, are actuated to couple the hanger plate and lateral projections from the hanger brackets which have threaded openings for receiving the jacking bolts. The clamping bolts may be clamped to hold the door weight while permitting the door to be moved slightly to vertically align the jacking bolts with the threaded openings. Once the jacking bolts have coupled the hanger plate to the hanger brackets, the jacking bolts may be used to support the complete weight of the door while they are actuated through appropriate openings in the hanger bracket and hanger plate to align the door and set the sill gap; or, the clamping bolts may help support the weight of the door while permitting sliding movement between the hanger brackets and hanger plates as the jacking bolts are turned. The desired door alignment and sill gap dimension are easily and quickly achieved by merely turning the jacking bolts, and then the clamping bolts are tightened to firmly clamp the hanger brackets to the hanger plate and maintain the desired alignment and sill gap.

In addition to saving installation time, the disclosed elevator system and door fastener arrangement provides many additional advantages. The door weight is cooperatively carried by the jacking bolts, the clamping bolts, and by the frictional area contact between the tightly clamped hanger brackets and hanger plate. The tightly clamped hanger brackets and hanger plate provide additional structural stiffness across the top of the door. The jacking bolt adjustment cannot change due to vibration, because of the positive lock on alignment and sill gap provided by the clamping bolts. The disclosed arrangement makes it unnecessary to provide any additional guides, as the preassembled hanger plate provides the required vertical plane, and the clamped flat surfaces of the hanger plate and hanger brackets provide the structural stiffness to maintain the alignment without auxiliary guides. Finally, a greater margin of safety is provided because several different pieces of hardware must all loosen before the door will lose the desired alignment and sill gap. If all of these parts should loosen and change the alignment and sill gap, it will cause binding of the door long before all of the hardware would completely uncouple to the point of allowing the door to fall.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENT

Figure 1:
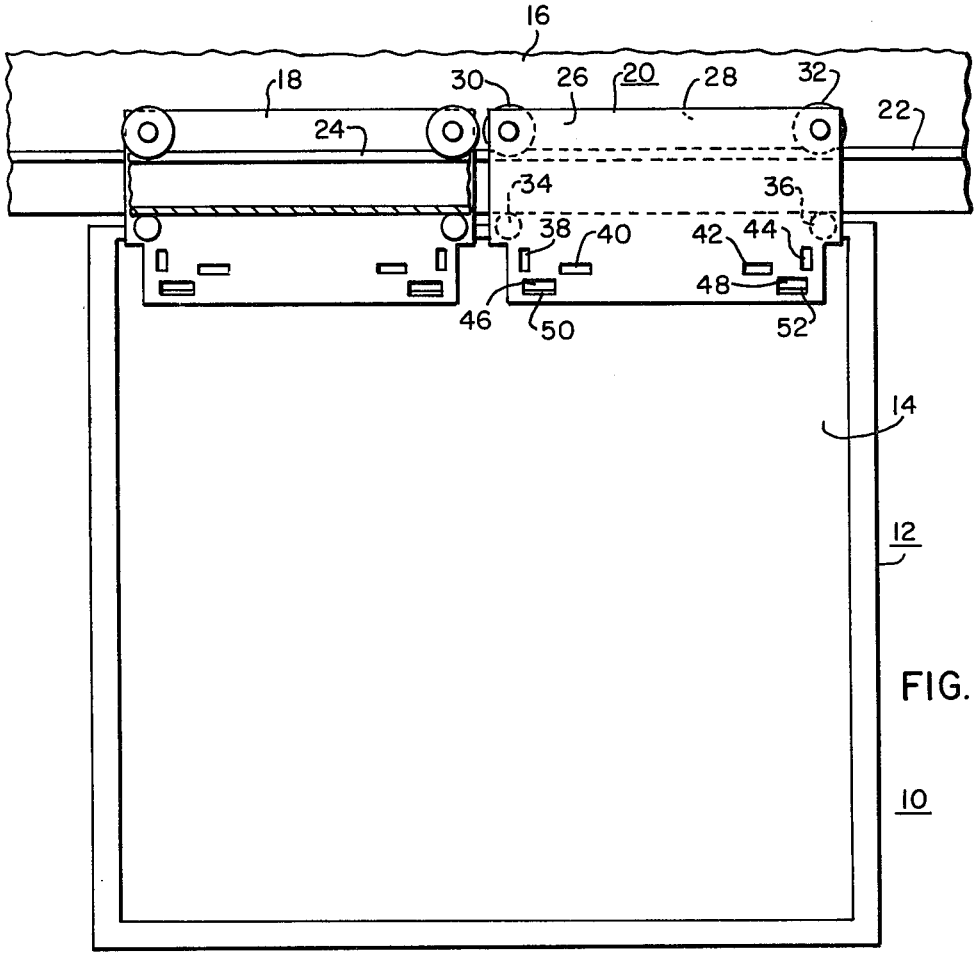
FIG. 1 is an elevational view of an elevator system including an elevator car having an entranceway, and a door operator having factory installed and adjusted hanger plates, constructed according to the teachings of the invention.

Referring now to the drawings and to FIG. 1 in particular, there is shown an elevational view of an elevator system 10 which may be constructed according to the teachings of the invention. Elevator system 10 includes an elevator car 12 mounted for vertical movement in the hoistway of a structure to serve the floors therein. The elevator system 10 may be of the traction type, or of the hydraulic type, as desired.

The elevator car 12, which is illustrated in FIG. 1 without door panels in order to more clearly illustrate and describe the invention, includes bottom, sides and top portions which define a passenger enclosure having a passenger opening 14. A closure system for opening and closing the entranceway 14 includes a door operator 16 mounted on the top portion of the elevator car 12. The specific type of door operator utilized is not important to the invention. For purposes of example, it will be assumed that the door operator is that shown in U.S. Pat. No. 4,004,655, which issued on application Ser. No. 608,481, filed August 28, 1975, which is assigned to the same assignee as the present application. However, instead of mounting the hanger plates to the door operator 16 in the field, the hanger plates are constructed according to the teachings of the invention, and they are factory mounted on the door operator 16 and shipped to the job site as a unit with all adjustments and dimensions pre-set.

The closure system may include a single door panel, or it may have two door panels arranged in either the center opening or the side opening type. If they are arranged to open to one side, they may be two-speed, including a fast door and a slow door. For purposes of example, it will be assumed that the closure system includes two door panels and thus first and second hanger plates 18 and 20 respectively, are mounted to the door operator 16.

The closure system is illustrated as being a two-speed door assembly opening to the right when viewing FIG. 1, with the hanger plate 20 being associated with a first hanger roller track 22, and with the hanger plate 18 being associated with a second hanger roller track 24 which is shown in fragmentary form in order to also illustrate the hanger roller track 22 which lies directly behind it in the elevational view of FIG. 1. Since each of the hanger plates 18 and 20 are of like construction except for the side thereof on which it hanger rollers are placed, only hanger plate 20 will be described in detail.

Hanger plate 20 is constructed from a flat, metallic sheet material, such as steel, having first and second major, flat, parallel, oppossed surfaces 26 and 28, respectively. The hanger plate 20 has a generally rectangular configuration, and, as viewed in FIG. 1, it includes first and second hanger rollers 30 and 32 journaled for rotation from its second side 28, adjacent to the upper left and upper right hand corners, respectively. Up thrust rollers 34 and 36 are also journaled for rotation from its second side 28, intermediate the upper and lower edges of the hanger plate.

Openings are formed through the hanger plate 20 for receiving hardware which couples the hanger plate 20 to the hanger brackets on the door panel. Openings 38 and 40 adjacent the lower left hand corner and openings 42 and 44 adjacent the lower right hand corner are rectangularly shaped slots for receiving clamping bolts, as will be hereinafter explained, and openings 46 and 48 adjacent the lower left and right hand corners, respectively, provide access to jacking bolts, as well be hereinafter explained. Lateral projections 50 and 52 extend from the bottom of openings 46 and 48 on the second side 28 of the hanger plate 20, which projections include openings for receiving jacking bolts.

Figure 3:
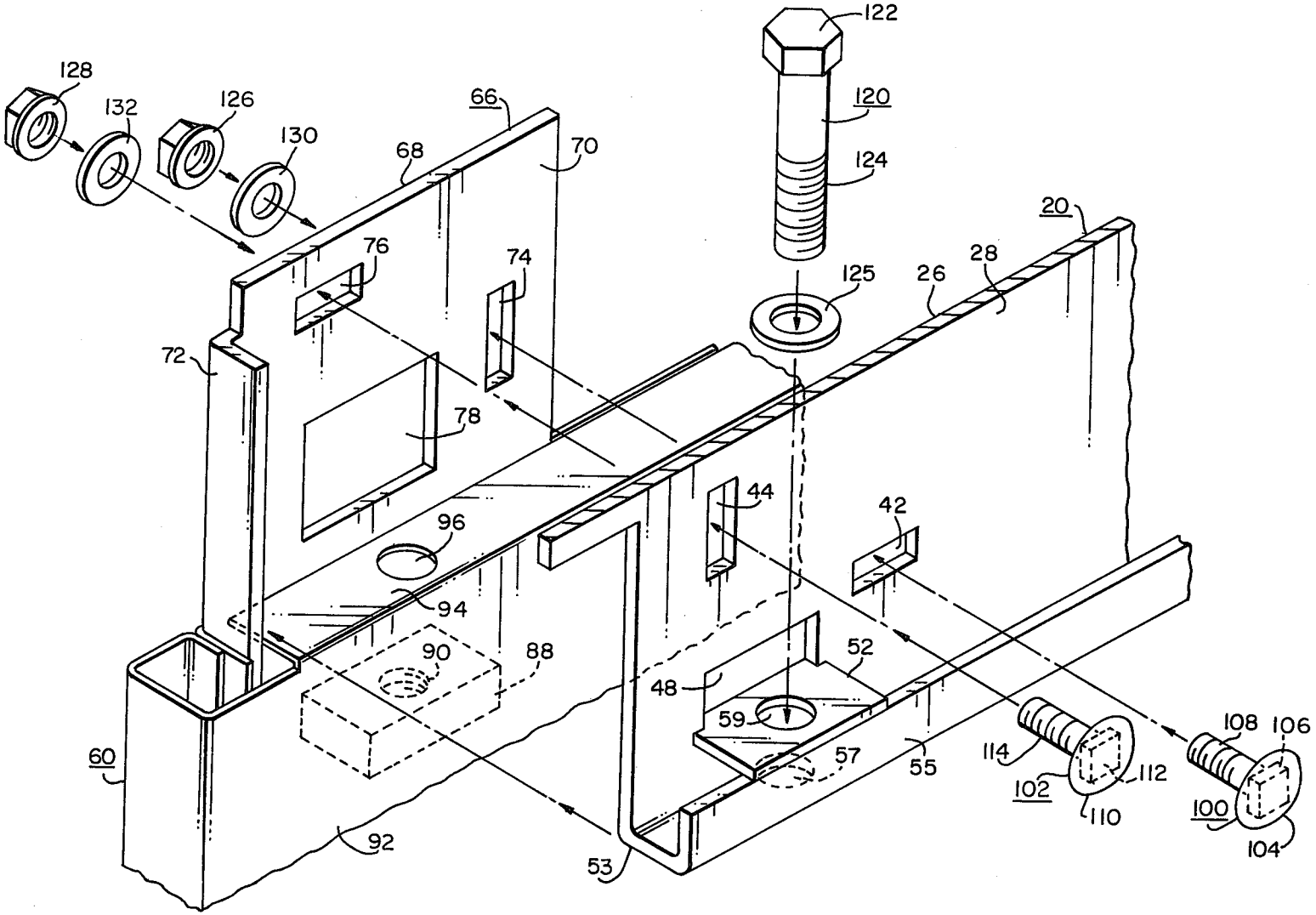
FIG. 3 is an exploded, fragmentary, perspective view illustrating how the hanger brackets of FIG. 2 are connected to the hanger plate of FIG. 1, according to the teachings of the invention.

As shown most clearly in FIG. 3, the bottom edge of the hanger plate may be bent to form a substantially J-shaped cross-sectional configuration including a bottom portion 53 and a lip 55. The lip 55 may be dimensioned to provide support for the lateral projections 50 and 52. The bottom portion 53 includes openings aligned with openings in the lateral projections for receiving the jacking bolt, such as opening 57 which is aligned with opening 59 in lateral projection 52.

The hanger plates 18 and 20 are factory mounted on their respective hanger roller tracks 24 and 22, and they are connected to the driving elements of the door operator 16 for rectilinear movement across the entranceway 14. All adjustments are pre-set, requiring no adjustment of the hanger plates 18 and 20 in the field.

Figure 2:
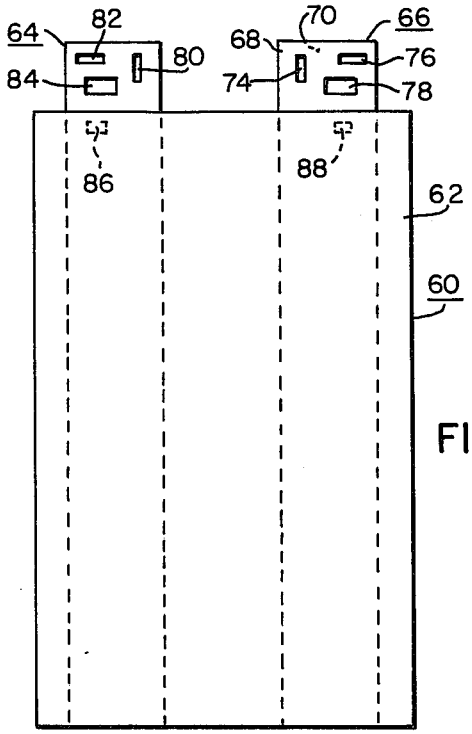
FIG. 2 is an elevational view of a door panel having integral hanger brackets, constructed according to the teachings of the invention.

FIG. 2 illustrates a door assembly 60 constructed according to the teachings of the invention. Door assembly 60 includes a door panel 62 having first and second hanger brackets 64 and 66 which projects upwardly from its upper left and right hand corners, respectively, with the hanger brackets being constructed as an integral part of the door assembly 60. Since each hanger bracket 64 and 66 is of similar construction, except for the fact that they are left and right hand versions of one another, only the right hand hanger bracket 66 will be described in detail.

More specifically, hanger bracket 66 may form a structural element of the door panel, with the hanger bracket being an integral extension of the structural element, extending above the top portion of the door panel 62. Hanger bracket 66 is formed from a flat sheet of metallic material, such as steel, having first and second major, flat, parallel opposed surfaces 68 and 70, respectively. As shown most clearly in FIG. 3, one edge of the bracket may be bent to form an L-shaped cross-sectional configuration, including a leg portion 72, to increase the stiffness of the bracket as well as to form a structural element of the door.

Hanger bracket 66 includes openings 74, 76 and 78 which extend between it major surfaces 68 and 70. Openings 74 and 76 are rectangularly shaped slots which cooperate with the rectangularly shaped slots 42 and 44, respectively, of the hanger plate 20, for receiving clamping bolts, as will be hereinafter explained, and opening 78 is a relatively larger opening which cooperates with opening 48 of the hanger plate 20 for providing access to a jacking bolt. In like manner, hanger bracket 64 includes openings 80, 82 and 84 which cooperate with openings 40, 38 and 46, respectively, of the hanger plate 20.

Hanger brackets 64 and 66 also include lateral projections 86 and 88, respectively, which are welded or otherwise fixed to the second major surfaces, with each of these projections having vertically oriented threaded openings, such as threaded opening 90 in projection 88, best shown in FIG. 3. The threaded openings 90 adjustably receive a jacking bolt.

The door 60, best shown in FIG. 3, includes an inner panel 92, which faces the passenger enclosure of the elevator car, which may include an integral portion 94 bent to provide the upper edge of the door. The lateral projections 86 and 88 are mounted below the upper edge of the door, between the inner panel and the second major surface of the hanger brackets 64 and 66. Thus, the integral bent portion 94 includes openings which are vertically oriented over the threaded openings of the lateral projections in order to receive the jacking bolts, such as opening 96 disposed above threaded opening 90 of lateral projection 88.

Figure 5:
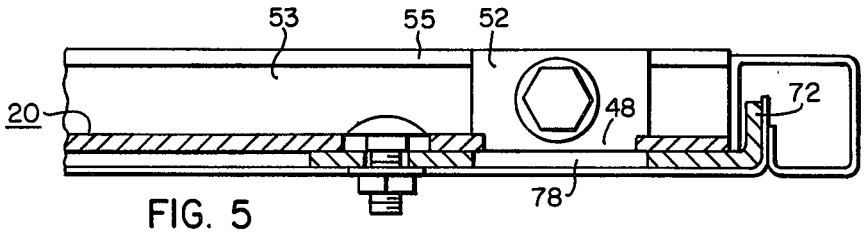
FIG. 5 is a plan view, in section, of the assembly shown in FIG. 4, taken between arrows V-V.
Figure 4:
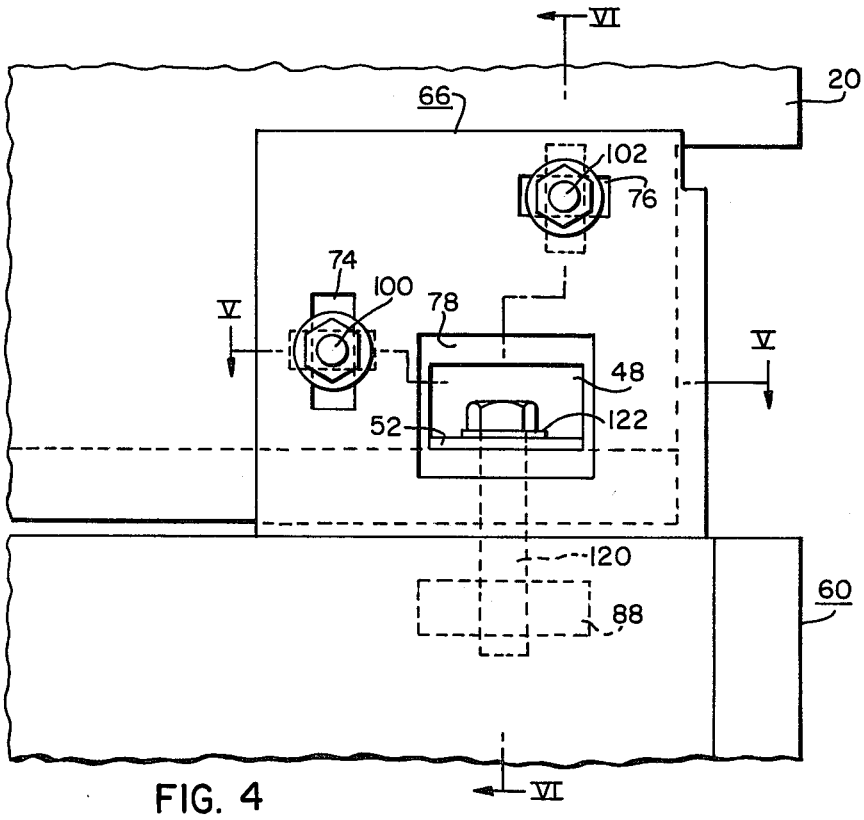
FIG. 4 is a fragmentary, elevational view illustrating the hanger bracket of FIG. 2 assembled relation with a hanger plate of FIG. 1.
Figure 6:
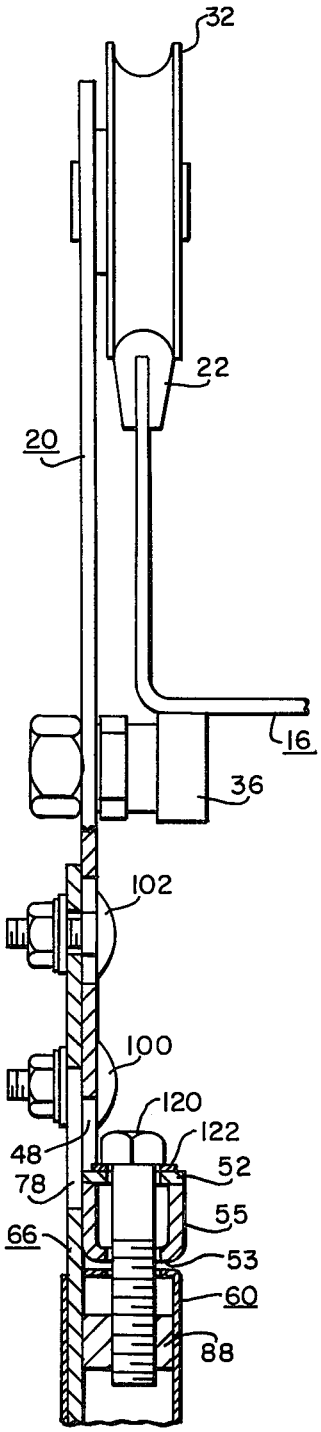
FIG. 6 is an elevational end view, partially in section, of the door fastener assembly shown in FIG. 4, with the section being taken between arrows VI—VI.

The new and improved hanger plate-hanger bracket assembly, as well as the method of assemblying the hanger brackets to the hanger plate, will now be described. FIGS. 2, 3, 4 and 5 will be referred to in the following description, with FIG. 3 being especially useful as it illustrates an exploded perspective view of the assembly of the hanger bracket 66 with the hanger plate 20. FIGS. 4, 5 and 6 are elevational, plan and end views respectively, of the completed assembly of the hanger bracket 66 to the hanger plate 20. FIG. 5 is a sectional view taken between arrows V—V of FIG. 4, and FIG. 6 is also a sectional view, taken between arrows VI—VI of FIG. 4.

More specifically, the first step of the method of assemblying the door 60 to the door operator 16 includes coupling the hanger brackets 64 and 66 to the hanger plate 20 with clamping bolts. Since the assembly of each hanger bracket 64 and 66 to the hanger plate 20 is similar, only the assembly of hanger bracket 66 to the hanger plate 20 will be described in detail. First and second clamping bolts 100 and 102 are provided, with clamping bolts 100 and 102 preferably being carriage bolts. For example, clamping bolt 100 includes a round head 104, a non-threaded intermediate portion 106 having a square cross-sectional configuration, and a threaded shank portion 108. In like manner, clamping bolt 102 includes a head 110, an intermediate portion 112, and a threaded shank portion 114. The rectangularly shaped slots 42, 44, 74 and 76 are dimensioned and oriented to snugly receive the non-threaded intermediate square shaped portions of the clamping bolts. The clamping bolts are inserted through openings 42 and 44 of the hanger plate 20 with the heads 104 and 100 against the second major surface 28 and with the threaded shank portions 108 and 114 extending perpendicularly outward from the first major surface 26. If desired, the clamping bolts 100 and 102 may be already factory mounted and temporarily held in place and centered in their respective slots with masking tape disposed across the head portions and the adjacent surface of the hanger plate. A jacking bolt 120 and associated washer may also be pre-positioned, with the jacking bolt held in openings 59 and 57 with masking tape such that it does not extend below the opening 57. The jacking bolts, which is a machine bolt, has a hex head 122 and a threaded shank 124.

The door 60 is then placed adjacent to the hanger plate 20 and moved towards the hanger plate such that the shank ends 108 and 114 of the clamping bolts 100 and 102, respectively, enter the rectangularly shaped openings or slots 74 and 76, respectively, of the hanger bracket 66. Nuts, such as Whiz lock nuts 126 and 128, and washers 130 and 132, are assembled with the threaded shanks 108 and 114, respectively, to couple the second major surface of the hanger bracket 66 against the first major surface 26 of the hanger plate 20. A similar procedure couples the hanger bracket 64 to the hanger plate 20. The nuts 126 and 128 are snugged only to the point of holding the weight of the door while allowing slidable movement of the door by the assembler to orient the jacking bolt 120 over the opening 96. Once the jacking bolts are aligned with these openings, each may be vertically advanced to the threaded opening of the associated lateral projection and engaged therewith with a wrench inserted through the aligned openings 78 and 48. It will be noted that the aligned slots for receiving the clamping bolts have their longest dimensions perpendicular to one another in order to provide considerable adjustment of the position of the door both vertically and laterally.

The jacking bolts, once engaged with their associated lateral projections will support the complete weight of the door. Thus, the clamping bolts may be loosened, if desired, or they may be maintained in their original positions to help support the weight of the door while allowing sliding contact between the hanger brackets and hanger plate as the door is urged into its final orientation and position by actuation of the jacking bolts.

The installer merely adjusts each jacking bolt to align the door 60 and set the sill gap. Once the alignment and desired sill gap are achieved, the clamping bolts 100 and 102 are tightened to securely clamp or lock the second major surface 70 of the hanger bracket 66 to the first major surface 26 of the hanger plate 20, and the hanger bracket 64 is secured in the same manner.

The method of assembly according to the teachings of the invention permits the hanger plate 20, with hardware in place, to be factory mounted to the door operator 16 and shipped as a package to the job site. All adjustments are factory set. Since no vertical adjustments are made on the hanger plate in the field, hardware clearances remain fixed and there is no possibility for interference on a two-speed door. Standard hanger brackets are formed as integral parts of the doors and they are shipped to the job site. The doors are easily mounted to the hanger plate and all adjustments are made from the hall side with a wrench. One installer may easily align the door and set the sill gap without manhandling the door or inserting shims. There is also no possibility of mounting right hand hangers plates on left hand doors.

The resulting hanger bracket-hanger plate assembly also provides many functional advantages. The assembly clamps two flat surfaces together which increases the structural stiffness of the door support structure across the top of the door. The area frictional contact between the two bolted plate members assists the clamping bolts and jacking bolts in holding the door weight. The structural stiffness of the assembly eliminates the necessity for additional guides. The slots through which the clamping bolts extend limit the amount of door movement in the event that all of the hardware should loosen. There is less chance for the door to become loose, as a large number of parts all have to work loose before the door will move from the desired clamped position.

I claim as my invention:

1. An elevator system comprising:

an elevator car having an entranceway, a door for said entranceway, said door having top, bottom and side portions, and first and second horizontally spaced hanger brackets on the top portion, said first and second hanger brackets each including an upstanding portion having first and second vertically oriented major opposed surfaces, door operator means mounted on said elevator car having a depending hanger plate member mounted for rectilinear movement adjacent said entranceway, said hanger plate member including first and second vertically oriented major opposed surfaces, and a width dimension selected to allow the second major surface of both the first and second horizontally spaced hanger brackets to simultaneously contact the first major surface of the hanger plate member, said hanger plate member and said first and second hanger brackets each having openings therein which extend between the associated major opposed surface, fastener means, including horizontally oriented bolts for adjustably clamping the second major surfaces of said first and second hanger brackets to the first major surface of said hanger plate member to provide frictional area contact therebetween, said horizontally oriented bolts of the fastener means extending between said openings in the hanger plate member and the first and second hanger brackets, which openings are aligned to accept said bolts, said horizontally oriented bolts being carriage bolts with the openings in the first and second hanger brackets and in the hanger plate member having rectangularly shaped elongated configurations dimensioned and oriented to receive a carriage bolt and prevent it from turning, with the directions of elongation of said openings being perpendicular to one another and oriented to permit both horizontal and vertical adjustment of the first and second hanger brackets relative to the hanger plate member, and first and second vertically oriented jacking bolts adjustably linking the first and second hanger plate members and the hanger bracket, respectively, said first and second jacking bolts cooperating with the fastener means and the frictional area contact between said first and second hanger brackets and said hanger member in supporting the weight of the door, said fastener means being adjustable to provide a first predetermined clamping force which permits slidable orientation of said door and said first and second hanger brackets relative to said hanger plate member and said entranceway by actuation of said first and second jacking bolts, said fastener means being further adjustable to provide a predetermined second clamping force, greater than the first, which maintains the selected orientation of said door while adding structural stiffness across the top portion of said door.

2. The elevator system of claim 1 wherein the hanger plate member and the first and second brackets each include lateral projecting portions, with the first and second jacking bolts linking the hanger plate member to the first and second hanger brackets, respectively, via said lateral projecting portions.

3. The elevator system of claim 2 wherein the hanger plate member and the first and second brackets each include openings therein which extend between their associated major opposed surfaces, with said openings being aligned and oriented relative to the first and second jacking bolts to permit adjustment thereof from the side of the door which is external to the elevator car.

4. A method of fastening an elevator door having first and second spaced hanger brackets, each of which includes first and second major opposed vertically oriented flat surfaces having rectangularly shaped elongated openings therethrough, to a door operator which includes a depending hanger plate having first and second major opposed vertically oriented flat surfaces having rectangular shaped elongated openings therethrough, each oriented with its elongated direction perpendicular to the elongated direction of a selected opening in a hanger bracket, comprising the steps of:

inserting carriage bolts through openings in the hanger plate such that the threaded ends extend perpendicularly outward from the first major surface, orienting the hanger brackets such that the threaded end of each bolt extends through the selected opening therein, engaging the threaded ends of the bolts with nuts, adjusting the position of the door horizontally within the range permitted by certain of the elongated openings, clamping the second major surfaces of the hanger brackets to the first major surface of the hanger plate with a first clamping force which creates frictional area contact sufficient to support the weight of the door while permitting slidable adjustment of the hanger brackets relative to the hanger plate, linking the hanger brackets and hanger plate with jacking bolts which move the door in a vertical direction when actuated while the hanger brackets are clamped to the hanger plate with a force equal to or less than the first clamping force, actuating the jacking bolts within the range permitted by certain of the elongated openings to provide the desired door alignment and vertical height dimension relative to the hanger plate, and clamping the second major surfaces of the hanger brackets to the first major surface of the hanger plate with a second clamping force sufficient to maintain the selected door alignment and vertical height dimension.

5. The method of claim 4 wherein the step of inserting bolts through openings in the hanger plate orients the bolts such that the threaded ends extend perpendicularly outward from the first major surface, and the linking step includes the step of inserting the jacking bolts downwardly through openings in lateral projections which extend outwardly from the second major surface of the hanger plate, and threadably engaging the jacking bolts with threaded openings in lateral projections which extend outwardly from the second major surfaces of the hanger brackets.

6. The method of claim 5 wherein the actuating step includes the step of actuating the jacking bolts from the side of the first major surface of the hanger brackets via aligned openings in the hanger brackets and hanger plate oriented to expose the jacking bolts.

* * * * *